United States Patent [19]

Quintilliano

[11] 4,033,407

[45] July 5, 1977

[54] HEAT EXCHANGER CLEANING SYSTEM

[75] Inventor: Robert L. Quintilliano, Whitehall, Mich.

[73] Assignee: Hooker Chemicals & Plastics Corporation, Niagara Falls, N.Y.

[22] Filed: Sept. 2, 1975

[21] Appl. No.: 609,864

[52] U.S. Cl. ..... 165/95; 165/1

[51] Int. Cl.[2] ..... F28F 27/02

[58] Field of Search ..... 165/1, 95

[56] References Cited

UNITED STATES PATENTS

| | | | |
|---|---|---|---|
| 2,328,837 | 9/1943 | Natwick | 165/95 |
| 2,488,598 | 11/1949 | Lockman | 165/95 |
| 2,490,750 | 12/1949 | Grewin | 165/95 |
| 2,490,759 | 12/1949 | Tyden | 165/95 |
| 2,576,843 | 11/1951 | Lockman | 165/95 |
| 2,647,570 | 8/1953 | Lockman | 165/95 |
| 2,707,991 | 5/1955 | Lockman | 165/95 |
| 2,788,065 | 4/1957 | Lockman | 165/95 |

*Primary Examiner*—Carroll B. Dority, Jr.
*Assistant Examiner*—Daniel J. O'Connor
*Attorney, Agent, or Firm*—Peter F. Casella; William R. Devereaux

[57] ABSTRACT

The present invention relates to a method for more efficiently operating a heat exchanger wherein heat is exchanged between a scale-forming and a scale-cleaning liquid. The scale-cleaning liquid is passed periodically into the region of the heat exchanger wherein scale from the scale-forming liquid has accumulated, and the effluent is flushed from the heat exchanger.

9 Claims, 3 Drawing Figures

HEAT EXCHANGER CLEANING SYSTEM

BACKGROUND OF THE INVENTION

The present invention relates to a method of maintaining the inside surfaces of a heat exchanger substantially clean with respect to incrustations deposited from an influent fluid in indirect heat exchange relation with another fluid. The invention is particularly applicable to a brine exchanger in which feed brine for an electrolytic cell is preheated by incoming hot acidic chlorine water. From the incoming brine is deposited a calcium carbonate fouling layer on the brine side of the heat exchanger, which can be removed by reaction with the acidic chlorine water in accordance with the teachings of this invention.

It is known to contact hot, humid chlorine gas emanating from an electrolytic cell with feed brine for the cell in a heat exchanger whereby heat is transferred to the cell feed brine. U.S. Pat. No. 3,434,948, for example, shows a method for utilizing the sensible heat of cell gases to heat electrolyte feed solutions. Hot hydrogen cell gas is passed through a heat exchanger which transfers heat from the gas to cool feed brine. In another commercial embodiment, hot chlorine cell gas is passed into a direct contact cooler, and the hot effluent water is passed into a heat exchanger within which heat is transferred to cold influent cell feed brine. It has been found, however, in the operation of a heat exchanger of this type, that a calcium carbonate fouling layer is deposited on the brine side of the heat exchanger. These incrustations cause restriction of the flow of fluid through the heat exchanger and require disconnecting the brine process piping in order to introduce an acid cleaning solution, such as inhibited muriatic acid. A similar method has been suggested by Natwick in U.S. Pat. No. 2,328,837, where a strong aqueous sulfur dioxide solution is used to dissolve scale deposits in a heat exchanger. This requires not only a time-consuming shut-down of the process equipment, with an additional demand on the time of maintenance personnel, but also requires the introduction of special cleaning solutions, which result in additional cost.

In U.S. Pat. No. 920,570 to Heintzelman et al. is disclosed a method for cleaning the oil side of a heat exchanger used for preheating oil by the heat transferred from steam. A valve piping connection allows discharge of steam into the oil side, allowing obstructions which might have accumulated on the oil side to be forced from the heat exchanger under the direct blast of steam. No disclosure, however, of an adaptation of this concept to chemical, rather than mechanical, cleaning of an opposite side of a heat exchanger can be found in Heintzelman et al. Use of steam to accomplish the cleaning of incrustations deposited from the solution of a liquid-liquid heat exchanger is neither practical nor economical, and would require an even more complicated interruption in service of process equipment than that which would result from using the process of the Natwick patent.

U.S. Pat. No. 3,674,687, to Matheson cleans accumulated sludge from a sewage system heat exchanger through contact of the hot scale material with a mixture of cold air and water, which is forced through at high pressure to cause the scale material to contract rapidly and flake away. Reliance upon this mechanical washing action requires addition of a cleaning fluid from an external source, and the effect can be expected to last only as long as a temperature differential between incrustations to be cleaned, and cleaning fluid, is maintained. A purely chemical cleaning action, on the other hand, can be expected to remain effective as long as is necessary to remove incrustations. The present invention is applicable to heat exchangers designed for use with electrolytic cells and hydrochloric acid cells are typical examples of such cells. Since the electrolyte used in such cells is most advantageously maintained at a temperature above the ambient temperature, cold feed brine is often heated before introduction into such cells. Heat exchangers are employed to transfer heat from products of such cells to feed brine. Once such source of heated product is hot chlorine water, formed by dissolution of evolved chlorine gas to form a hot chlorine-water solution. However, this invention is not to be understood as being limited only to heat exchangers adapted for use in conjunction with chlor-alkali cells and hydrochloric acid cells, in that it is applicable to all heat exchangers. Although the invention will not be used only with chloralkali cells, the description herein will specifically describe the invention in relationship to a chlor-alkali cell, but it is to be understood that the present invention is also applicable generally to any use of a heat exchanger.

SUMMARY OF THE INVENTION

The present invention has numerous advantages over known methods of cleaning a fouled heat exchanger, particularly with respect to ease of operation and minimization of process equipment down time. Thus, a two-fold benefit is accomplished in that materials ordinarily passed through the heat exchanger may conveniently be used in the cleaning operation, and disconnecting of piping and reconnecting of piping and reconnection of cleaning lines is avoided. Relying upon the cleaning properties of the scale-cleaning influent liquid, the invention teaches use of this liquid by direct transfer through a by-pass cross-connection to the opposite side of the heat exchanger. The chemically active nature of the hot fluid causes scale incrustations to be removed, and a second cross-connection may be used to allow the flushed material to be exited from the system.

BRIEF DESCRIPTION OF THE DRAWINGS

The invention will be described with reference to the drawings, which are partial schematics and flow sheets of the present invention.

DESCRIPTION OF THE PREFERRED EMBODIMENTS

Figure 1:
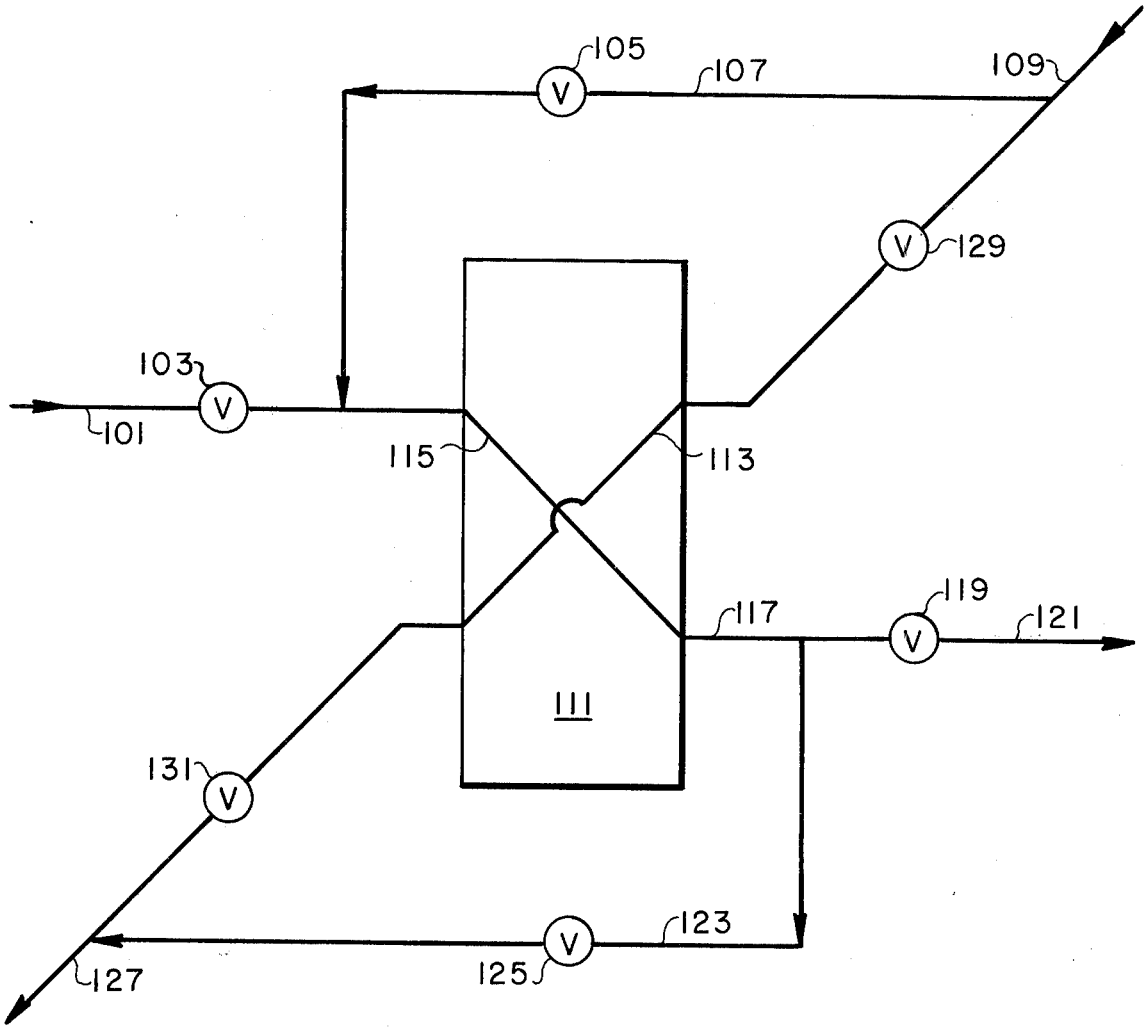
FIG. 1 illustrates the utilization of the hot influent fluid to clean the side of the heat exchanger into which cold influent fluid normally passes. A second bypass valved piping arrangement to conduct fluid fluid to the opposite effluent side is also illustrated in FIG. 1.

In FIG. 1, a heat exchanger 111, which may be a titanium plate heat exchanger, in ordinary operation effects a heat exchange between fluid passing through the space schematized as the line 113 and the fluid passing through the space schematized by line 115. With valves 105 and 125 in the closed position hot influent scale-cleaning liquid flows from line 109 through valve 129 and emerges after transferring heat in the heat exchanger 111 through open valve 131 and outline 127. Similarly, cold influent scale-forming liquid passes from line 101 through open valve 103 through the space schematized as line 115 inside heat exchanger 111, wherein heat is transferred to the fluid inside line 115 and in which region scale forms. This heated scale-forming fluid then emerges out line 117 from heat exchanger 111, through open butterfly valve 119, and out line 121. During the normal operation of the heat exchanger 111, butterfly valves 105 and 125 are closed, and no fluid flow through by-pass line 107 or by-pass line 123 can occur.

When a cleaning operation is to begin, butterfly valves 129, 131, 103, and 119 are closed, preventing flow of fluids through the heat exchanger. Butterfly valves 105 and 125 are then opened, and hot influent scale-cleaning liquid from line 109 then flows through line 107, through butterfly valve 105, and into the heat exchanger 111 through line 115, which is to be cleaned of accumulated scale incrustations. Hot cleaning fluid effluent emerges from the heat exchanger 111 through line 117, passes through bypass line 123, through open butterfly valve 125, and out line 127 for a sufficient time to clean the scale particles lodged inside line 115. The time for effective cleaning can typically range from about ten minutes to several hours, with about 30 to 60 minutes generally sufficient.

After completing a cleaning operation, butterfly valve 105 is closed, thus isolating bypass line 107. Butterfly valve 103 is then opened, allowing cold influent liquid to pass through line 101, through butterfly valve 103, into line 115 inside heat exchanger 111, through lines 117 and 123, through butterfly valve 125, and out line 127 until line 115 has been flushed of hot cleaning solution. Butterfly valve 125 is then closed, isolating bypass line 123, and operation of the heat exchanger 111 can then be resumed by opening butterfly valves 119, allowing brine to flow through the heat exchanger 111, and opening butterfly valves 129 and 131, allowing hot influent fluid to pass through the heat exchanger 111.

The heat exchanger is preferably a plate type heat exchanger, although other design types of heat exchangers can be used, such as spiral, tube and shell, and graphite block heat exchangers. A plate type heat exchanger consists of standard plates, which serve as heat transfer surfaces, and a frame to support them. The design principle is much like that of the plate-and-frame filter press. Pressure drop is low and interleakage of fluid is impossible. Plates are preferably constructed of a corrosion resistant material, such as titanium, pressed in a single piece and provided with grooves for rubber or other elastomeric gaskets or packing. Corrugated plate design can impart rigidity to the plate, inducing turbulence in the fluids, and assuring complete flow distribution. For titanium construction, the plate type heat exchanger can be significantly less expensive than tubular units.

In the preferred embodiment of the present invention, the influent scale-forming liquid comprises cold or cool brine, which emerges as hot brine from the heat exchanger in normal operation. In a commercial operation for the manufacture of chlorine and sodium hydroxide by the electrolysis of brine, chlorine gas evolved is absorbed by an aqueous medium to which is added from about 0.1 to about 1 weight percent of sulfuric acid. The purpose of the acidulation is to reduce the level of chlorine which may be absorbed, typically about 100 to about 1000 parts per million of chlorine. The resulting liquid, at a temperature of about 98° C to about 100° C, comprises the influent scale-cleaning liquid of acidulated hot chlorine water, which emerges as cooled chlorine water solution of a temperature of about 30° C to about 35° C. It is necessary to employ a corrosion-resistant piping material such as, for example, titanium pipes, titanium lined steel pipes, or pipes made of an inert polymeric material, such as polytetrafluorethylene or a corrosion resistant glass reinforced unsaturated polyester resin containing chlorendic acid and cured with styrene. The piping material must be resistant to chlorine water in the lines which ordinarily conduct chlorine water into and out of the heat exchanger, namely lines 109 and 127. Since the by-pass lines 107 and 123 also conduct chlorine water, these must also be resistant to hot chlorine water. Piping designed for conducting exclusively hot brine and cold brine, namely lines 101 and 121, can be manufactured from mild steel, stainless steel, rubber-lined steel, concrete, or other pipes resistant to corrosion in concentrated brine solution. Since all valves employed in this invention contact a chlorine-water solution on at least one side, these valves are preferably constructed of titanium. The butterfly valve type is particularly useful in this application, although other types of valves performing a substantially identical function are also contemplated in this invention, such as gate valves, diaphragm valves, or globe valves.

Figure 2:
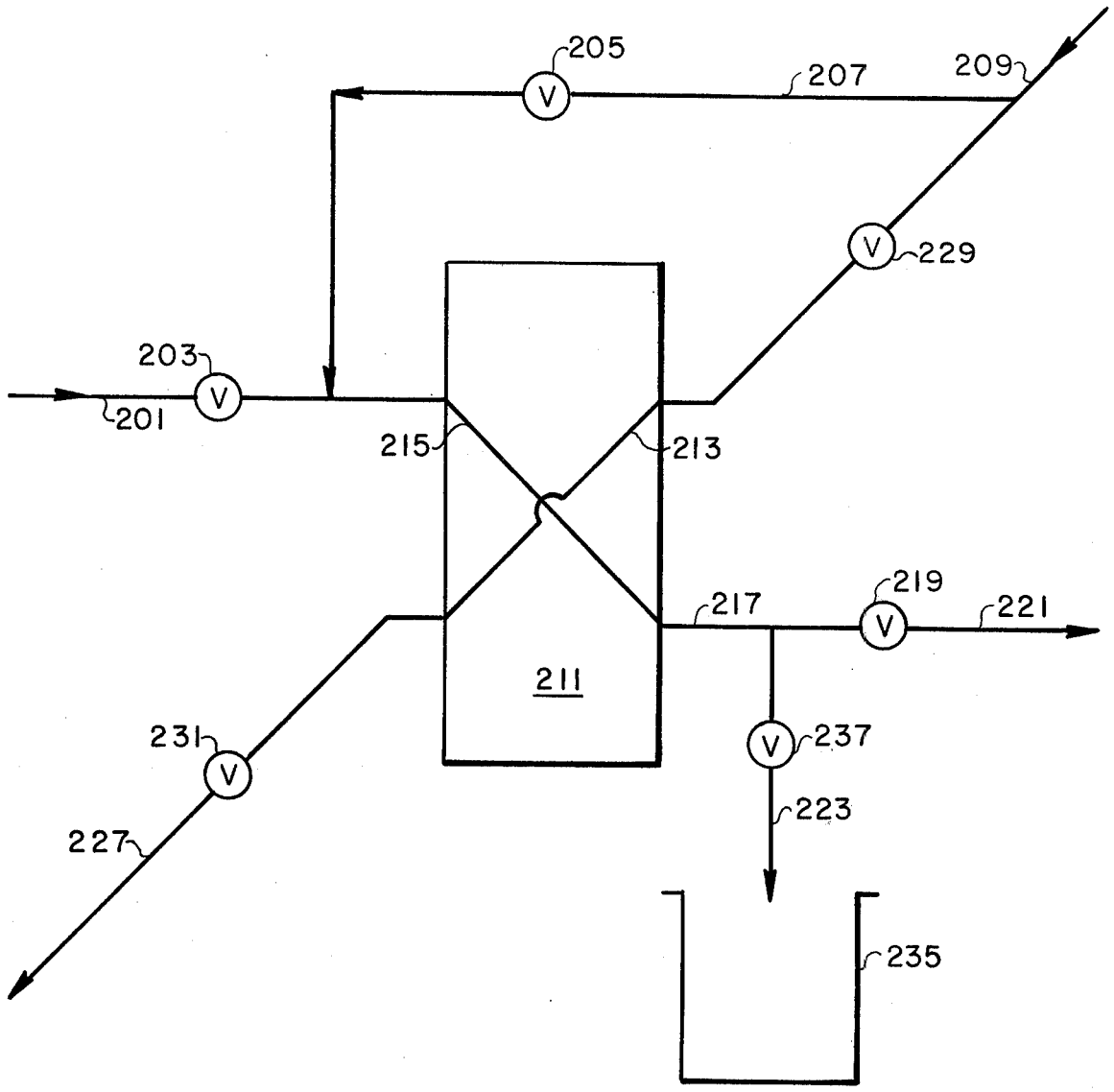
FIG. 2 illustrates an embodiment in which flush fluid is conducted to a separate receptacle.
Figure 3:
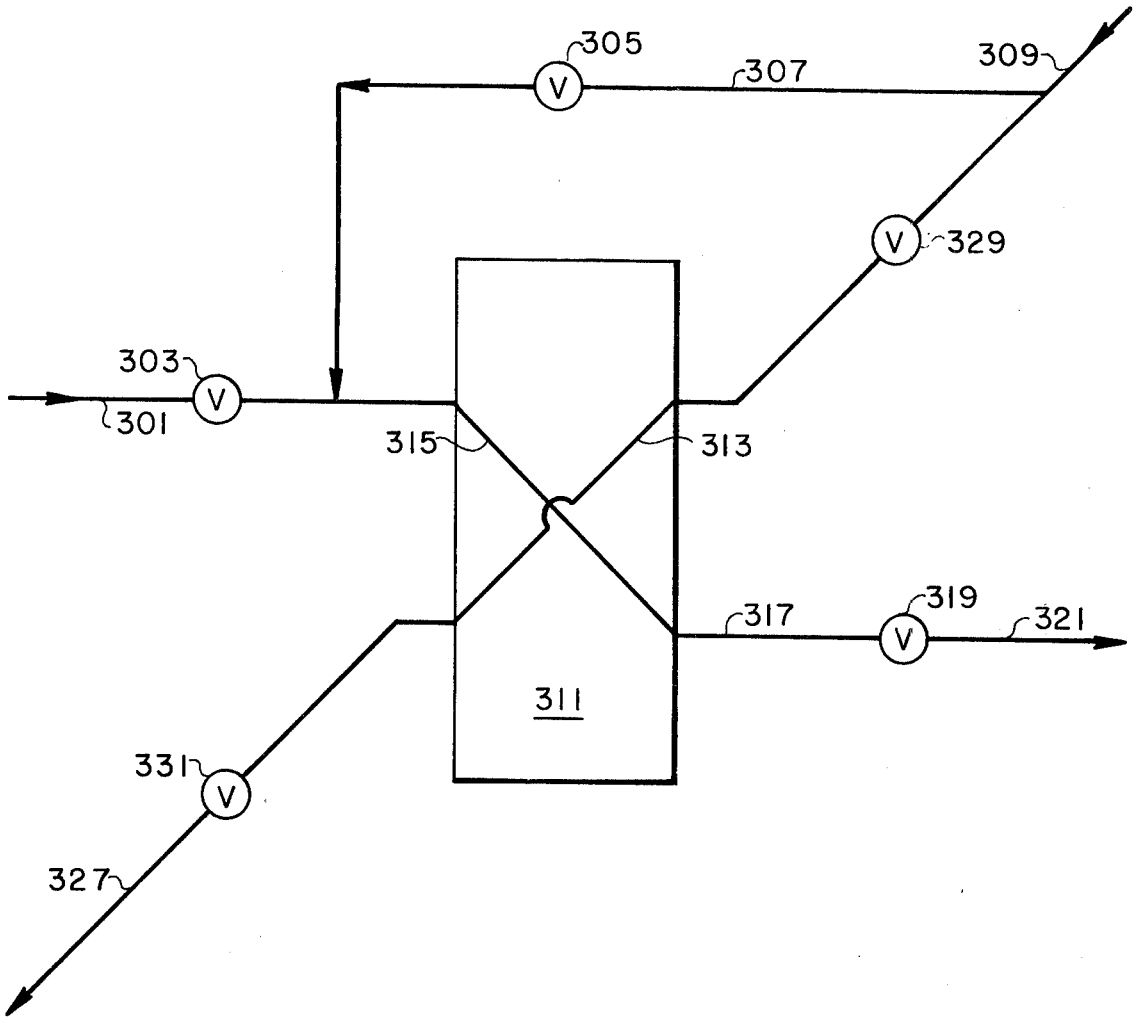
FIG. 3 illustrates an embodiment without the second bypass valve piping arrangement.

While the invention as described above shows a by-pass line 123 which allows flushed material generated during the cleaning operation to pass out the cooled effluent line 127 in the preferred embodiment, in another embodiment, the flushed material can be directed instead to a collecting receptacle 235, as illustrated in FIG. 2, or the flushed fluid can exit through valve 319 and out line 321, as illustrated in FIG. 3.

Referring to FIG. 2, heat exchanger 211 effects a heat exchange between hot influent scale-cleaning liquid flowing from line 209 through valve 229 into space 213, and emerging through open valve 231 and out line 227. Cold influent scale-forming liquid passes from line 201 through valve 203 into space 215 inside heat exchanger 211, emerging from line 217 through open valve 219 and out line 221. During normal heat exchange operation of heat exchanger 211, valves 205 and 237 are closed with no fluid flow through by-pass line 207. To begin cleaning operation, valves 203 and 219 are closed, valves 205 and 237 are opened, and hot scale-cleaning liquid from line 209 flows through line 207, through valve 205, into heat exchanger 211 through line 215, which is cleaned of scale. Hot cleaning fluid emerges from heat exchanger 211 through line 217, through valve 237 and into collecting receptacle 235. Cleaning takes place for a sufficient time to remove scale produced in line 215.

Referring now to FIG. 3, with valve 305 in a closed position, in normal heat exchange operations hot influent scale-cleaning liquid enters heat exchanger 311 from line 309 through valve 329, passes through the heat exchanger 311 through line 313, and emerges through open valve 331 and out line 327. Cold influent scale-forming liquid passes from line 301 through open valve 303 into heat exchanger 311 through space 315, and emerges out line 317, through open valve 319 and out line 321. During normal heat exchange operation of heat exchanger 311, valve 305 is closed, with no fluid flow through by-pass line 307. To effect a cleaning operation, valve 303 closed, and valve 305 is opened. Hot scale-cleaning influent liquid from line 309 flows through line 307, through open valve 305, and into heat exchanger 311 through line 315, wherein accumulated scale is removed. Cleaning fluid effluent emerges from heat exchanger 311 through line 317, through valve 319 and out line 321, for a sufficient time to remove scale deposited within line 315 by the scale-forming liquid.

The drawings and the following example serve to illustrate the invention but are not intended to limit it. Temperatures are expressed in degrees centigrade unless specified otherwise.

EXAMPLE

Brine at a concentration of about 25 weight percent sodium chloride and at a temperature of 23° C was fed through a 6 inch diameter mild steel pipe at an approximate rate of 360 gallons per minute into a Type 31 plate heat exchanger (manufactured by American Heat Reclaiming Corp.) and emerged at a temperature of 60° C. A solution of chlorine in water, derived during chlorine processing and containing approximately 0.5 weight percent of sulfuric acid and 200 parts per million of chlorine, at a temperature of 99° C was fed into the heat exchanger at a rate of 215 gallons per minute, and emerged at a temperature of 33.5° C. A piping arrangement as set forth in FIG. 1 was used, and all piping carrying a chlorine water solution, including by-pass lines, was constructed of a corrosion resistant glass reinforced unsaturated polyester resin containing chlorendic acid, cured with styrene. By-pass pipes were 3 inches in diameter. A reducing coupling reduces the brine inlet and outlet to 4 inches diameter immediately adjacent to the heat exchanger. After 5 weeks of continuous operation, the transfer of heat through the heat exchanger was significantly reduced by scale incrustations formed inside the heat exchanger, and the pressure drop of brine increased from the normal differential of about 10 psi to 20 psi. The influent and effluent lines were valved off, and the by-pass lines 107 and 123 were opened. After 45 minutes, scale incrustations were substantially removed, and the influent lines were reopened, giving a pressure differential of the brine line of 12 psi and a temperature differential of 36° C (compared with a previous temperature differential of 28° C).

I claim:

1. In a method for operating a brine heat exchanger comprising a heat exchange region through which pass in heat exchange relationship from a first liquid influent line a hot acidulated solution of chlorine in water possessing scale-cleaning properties and from a second liquid influent line a second liquid comprising brine and possessing scale-forming properties, a first liquid effluent line, and a second liquid effluent line, the improvement wherein said solution of chlorine in water is periodically passed into the second liquid influent line of said heat exchange region and then through said heat exchanger for sufficient time to remove scale produced by said second liquid.

2. The method of claim 1 wherein the heat exchanger is a titanium plate heat exchanger.

3. The method of claim 1 wherein said second liquid is introduced into and conducted from said heat exchanger through steel piping, and said solution of chlorine in water is introduced into and conducted from said heat exchanger through a corrosion resistant piping substantially inert to an acidulated solution of hot chlorine in water.

4. The method of claim polyester wherein said corrosion resistant piping is a thermoset unsaturated polymer resin.

5. The method of claim 1 wherein said solution emerges from said heat exchange region and is conducted by means of a valved pipe to said first liquid effluent line.

6. The method of claim 1 wherein said solution is conducted out of said heat exchanger into said second liquid effluent line.

7. The method of claim 1 wherein said solution is conducted out of said heat exchanger into a collecting receptacle.

8. In a method for operating a titanium plate heat exchanger through which pass in heat exchange relationship a first liquid comprising an acidulated solution of chlorine in water and a second liquid comprising brine, the improvement wherein said first liquid is introduced into and conducted from said heat exchanger through thermoset unsaturated polyester resin piping and is periodically passed into the region of said heat exchanger wherein said second liquid is normally passed for sufficient time to remove scale produced by said second liquid.

9. In a method for operating a brine heat exchanger in which feed brine for an electrolytic cell is preheated by incoming hot acidic chlorine water, said heat exchanger comprising a heat exchange region through which pass in heat exchange relationship from a first liquid influent line, a hot solution of chlorine in water, and from a second liquid influent line brine possessing scale-forming properties, a first liquid effluent line, and a second liquid effluent line, the improvement wherein said hot acidic chlorine water is periodically passed into the second liquid influent line of said heat exchange region and then through said heat exchanger for sufficient time to remove scale produced by said brine.

* * * * *

UNITED STATES PATENT OFFICE

CERTIFICATE OF CORRECTION

PATENT NO. : 4,033,407

DATED : July 5, 1977

INVENTOR(S) : Robert L. Quintilliano

It is certified that error appears in the above-identified patent and that said Letters Patent are hereby corrected as shown below:

Column 1, line 10, change "brine exchanger" to -- brine heat exchanger --.

Column 2, line 35, delete "and reconnecting of piping".

line 53, change "fluid fluid" to -- flush fluid --.

Claim 4, line 1, change "claim polyester" to -- claim 3 --;

line 3, change "mer resin." to -- ester resin. --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*